United States Patent [19]

Jurkowski

[11] 4,285,090

[45] Aug. 25, 1981

[54] CLEANING DEVICE FOR COLD PRESSURE FUSING ROLLER

[75] Inventor: Walter J. Jurkowski, Fairfield, Conn.

[73] Assignee: Pitney Bowes Inc., Stamford, Conn.

[21] Appl. No.: 96,702

[22] Filed: Nov. 21, 1979

[51] Int. Cl.[3] ..... G03G 21/00

[52] U.S. Cl. ..... 15/256.51; 100/174; 118/652; 355/15; 425/230

[58] Field of Search ..... 15/256.51; 100/174; 118/261, 652; 355/15, 3 FU; 101/425; 425/230

[56] References Cited

U.S. PATENT DOCUMENTS

| | | | |
|---|---|---|---|
| 3,048,874 | 8/1962 | MacDonald | 15/256.51 |
| 3,429,282 | 2/1969 | Ruiz | 15/256.51 X |
| 4,101,215 | 7/1978 | Fottner et al. | 355/15 |

FOREIGN PATENT DOCUMENTS

| | | | |
|---|---|---|---|
| 32952 | 5/1911 | Sweden | 425/230 |

*Primary Examiner*—Edward L. Roberts

*Attorney, Agent, or Firm*—Lawrence E. Sklar; William D. Soltow, Jr.; Albert W. Scribner

[57] ABSTRACT

In combination, a cylindrical cold pressure fusing roller for an electrophotocopying machine and a section of wire helically strung across the surface of the cold pressure fusing roller for removing electrostatic toner particles from the cylindrical surface of the cold pressure fusing roller.

10 Claims, 4 Drawing Figures

CLEANING DEVICE FOR COLD PRESSURE FUSING ROLLER

BACKGROUND OF THE INVENTION

The instant invention relates to electrostatic copying machines, and more particularly to a cleaning device for cold pressure fusing rollers in such machines.

Conventionally, in the direct or indirect electrostatic coping process, for the fixing of a developed image formed of a proper toner on a permanent record carrier, various fixing processes may be used. According to a known fixing process, the permanent record carrier (such as a paper sheet) is passed between a heated fixing roller and a pressure roller which is in engagement with the fixing roller. During this step the powder of the toner image is melted on the sheet and is caused to adhere thereto. This process, however, still has certain drawbacks. A portion of the toner sticks to the circumferential surface of the fixing roller which contacts the toner image; these adhered residues then are transferred to the consecutive record carriers, thus causing soiling thereof. In case the temperature of the fixing roller is too low, unmelted powder adheres thereto and is pressed, in an offset-like manner, onto the successive record carriers. If, on the contrary, the temperature of the fixing roller is too high, melted powder may adhere thereto and again, soil the successive sheets. In order to prevent such an offset soiling of the permanent record carriers, it is necessary to carefully control the fixing temperature. Such a control of the fixing temperature, however, is fraught with difficulties.

More recently, due to the availability of new toners, another fixing process has been introduced wherein the toner image is fixed without the use of heat by means of generating a sufficiently high pressure between the two rollers. In this process too, after the pressure fixing, a certain quantity of toner remains on the cylindrical surface of the fixing roller which had contacted the toner image; these toner portions have to be removed as well, since the residual toner adhering to the fixing roller would again lead to the above-noted offset soiling of the record carriers.

It is a common practice to provide a device to remove the excess toner accumulated on the cold pressure fixing rollers, one such device being a scraper blade. However, there are certain problems attendant with the use of scraper blades, such as annoying squeaks and insufficient wear characteristics. In those fixing roller assemblies where the rollers are skewed, i.e. cross each other, there is posed an additional problem of conforming the scraper blade to the surface of the roller, making skewed fixing rollers especially difficult to clean. The foregoing problems are all overcome by the instant invention.

SUMMARY OF THE INVENTION

Accordingly, the instant invention provides, in combination, a cylindrical, cold pressure fusing roller, and a section of wire helically strung across the surface of the cold pressure fusing roller for removing electrostatic toner particles from the cylindrical surface of the cold pressure fusing roller.

DETAILED DESCRIPTION

Figure 1:
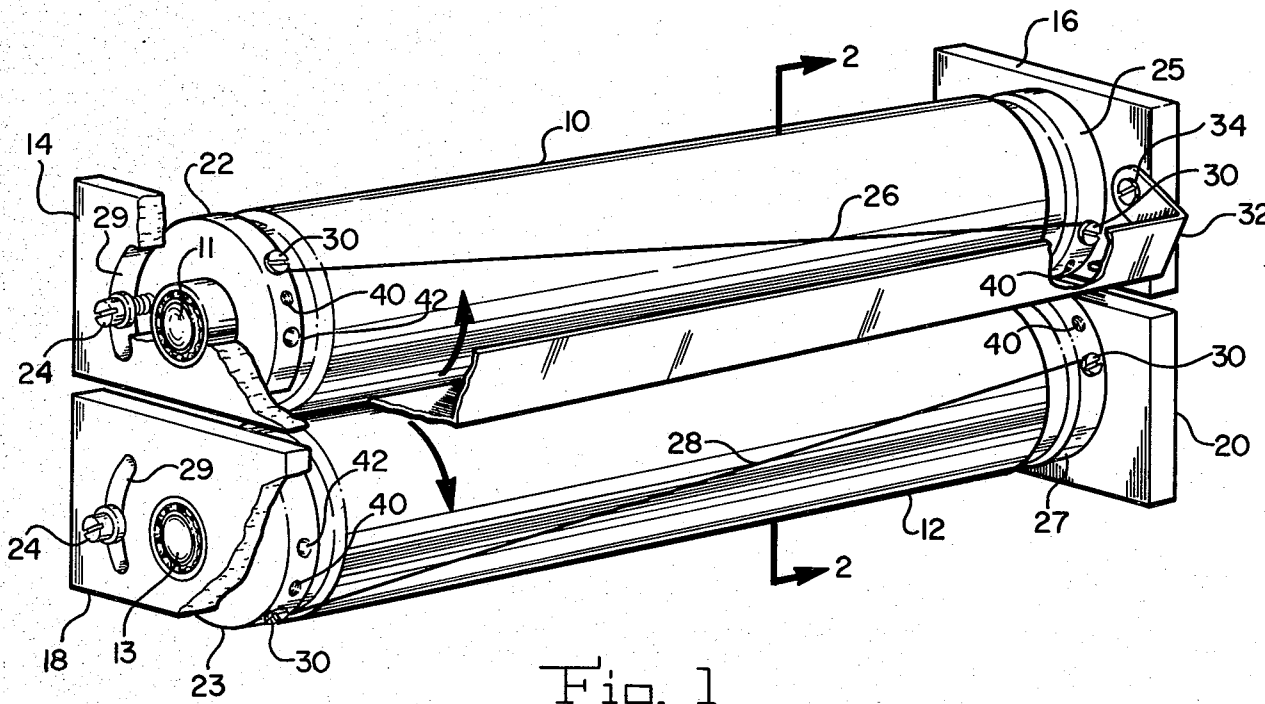
FIG. 1 is a perspective view of a cleaning device for a pair of cold pressure fusing rollers according to the instant invention.

In describing the preferred embodiment of the instant invention, reference is made to the drawings, wherein there is seen in FIG. 1 a pair of cold pressure fixing rollers 10 and 12 secured to shafts 11 and 13 respectively. The upper shaft 11 is rotatably mounted in side frames 14 and 16 while the bottom shaft 13 is rotabably mounted in side frames 18 and 20. The side frames 14, 16, 18 and 20 are all secured to a housing for an electrostatic copying machine, not shown, in a manner well known to those skilled in the art. Each of the rollers 10 and 12 is flanked by a pair of truncated, stationary discs 22, 23, 25 and 27 through which the shafts 11 and 13 rotate. The left side discs 22 and 23 are adjustably secured to the side frames 14 and 16 by means of set screws 24 seated in arcuate slots 29 formed in the side frames 14 and 16.

Figure 2:
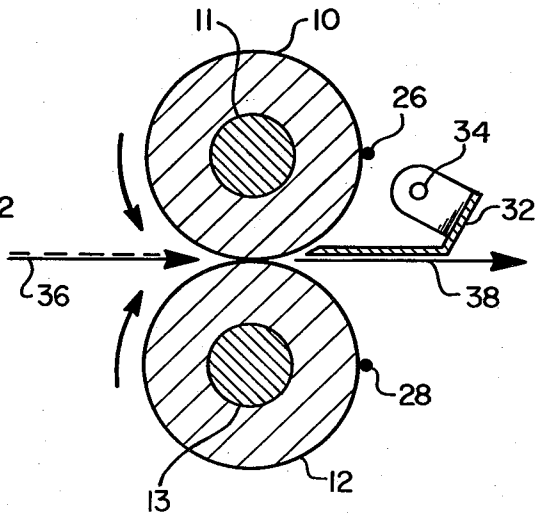
FIG. 2 is a sectional view taken on the vertical plane indicated by the line 2—2 in FIG. 1.
Figure 4:
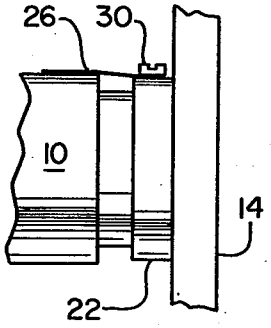
FIG. 4 is a fragmented, axial view of the cleaner and upper roller seen in FIG. 1.

As seen in FIGS. 1 and 2, each of the rollers 10 and 12 is provided with a section of music wire 26 and 28 respectively on the exit side of the rollers. The music wires 26 and 28 wrap around their respective rollers helically about ¼ turn (90°) in order to assure continuous linear contact with the rollers. The music wires 26 and 28 are secured to the discs 22 by means of screws 30. The diameters of the discs 22 are slightly less than the diameters of the rollers 10 and 12, as best seen in FIG. 4, thereby assuring the desired continuous linear contact between the wires and their respective rollers. A catcher tray 32 is secured to the side frames 14 and 16 with screws 34 to prevent any of the toner particles removed by the upper wire section 26 from dropping onto the fused copy paper (indicated by arrows 36 and 38 in FIG. 2). If desired a second catcher tray may similarly be added for use with the lower roller 12 and wire 28.

An open threaded aperture 40 is shown adjacent each of the screws 30 so that a second wire may be added to each roller, as explained hereinbelow with reference to FIG. 3. Additionally, each of the left side discs 22 and 23 includes an opening 42 in its periphery to permit insertion therein of a lever arm to apply a torque to the discs 22 and 23 to thereby provide the appropriate, predetermined tension to the wires 26 and 28.

Figure 3:
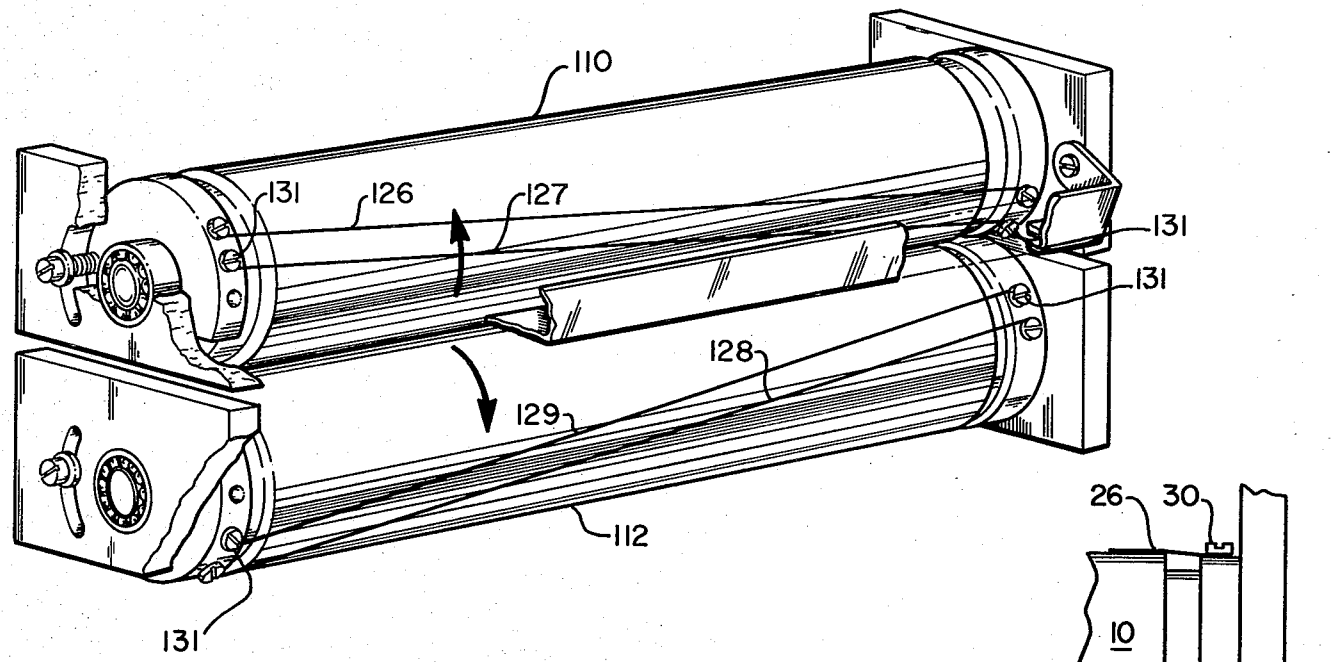
FIG. 3 is identical to FIG. 1 except it shows two wires for each roller.

In FIG. 3 is seen an alternative embodiment of the instant invention, wherein an upper roller 110 and a lower roller 112 is each provided with a pair of wire sections. Wire sections 126 and 127 are circumferentially spaced about 20° from each other across the top roller 110, while wire sections 128 and 129 are also circumferentially spaced about 20° from each other across the lower roller 112. Additional screws 131 are seated in the threaded apertures 40 (best seen in FIG. 1) for securing wire sections 127 and 129. With a second wire on each roller, the chance for developer material to remain on the roller is minimized. All other elements of the embodiment shown in FIG. 3 are identical to those shown in FIG. 1.

Music wire is the preferred form of wire for use in the instant invention, owing to the fact that it possesses enduring mechanical properties, including hardness and elasticity. Music wire is thus able to withstand any lack of concentricity or cylindricity in the fixing rollers. Since even the best fixing rollers, despite elaborate grinding procedures, are eccentric to some degree, and not completely cylindrical from end to end, music wire is preferred for virtually all types and qualities of fixing rollers.

Although the wire sections are shown as making about a $\frac{1}{8}$ turn about the rollers, the turn for any given wire section can vary between about $\frac{1}{4}$ and 1/360 of a turn. This wrapping relationship between the wire section and the roller assures, together with the ends of the wire sections being secured at points within the circumference of the fixing rollers, continuous, linear contact between the wire sections and the fixing rollers.

While music wire is preferred for the wire sections, other materials that may be used include stainless steel, plastic, leather and copper. Although most wire sections are circular in cross section, it may prove advantageous to employ a wire section which is square or rectangular in cross section.

While the wire sections have been shown situated at about the 3 o'clock position on the exit side of the pressure fixing rollers, they may be located on the entry side also but with less advantage. Obviously, the wire section should not cross over the top of the fusing roller in order to obviate problems with previously removed toner particles falling back on the roller, but may otherwise be situated almost anywhere relative to the roller and depending on the amount of turn in the wire. For example, if one were using only a 1/360 turn in the wire, the wire should not be situated near the top of the roller, but rather closer to the middle of the roller, and preferably split on either side of the 3 o'clock position. In general, it is preferred to locate the wire along the lower half of the roller.

The adjustment in the tension of the wire sections is easily accomplished by slightly loosening the set screws 24, applying a torque to the discs 22 and 23 using a lever arm inserted in the holes to gain the desired tension, and then tightening the set screws 24.

Obviously, if the paper passing through the fuser is an uncut web, having no separations therein, it is superfluous to have any wire sections on the lower roller.

Various other modifications, alternative constructions and equivalents may be employed without departing from the true spirit and scope of the invention, as exemplified in the foregoing description and defined in the following claims.

What is claimed is:

1. In combination, a cylindrical roller, a section of wire helically strung across the cylindrical surface of said roller for removing particles from the cylindrical surface of said roller, and a pair of discs flanking the ends of said roller for providing continuous linear contact between the section of wire and said rollers, said discs having a diameter less than the diameter of said roller, and wherein said section of wire is fixedly secured to the peripheral surfaces of said discs.

2. The combination of claim 1, wherein the section of wire wraps helically around said roller between about $\frac{1}{4}$ and 1/360 of a turn.

3. The combination of claim 1, further including a second section of wire helically strung across the surface of the roller for removing particles missed by the first section of wire.

4. The combination of claim 3, wherein the second section of wire is circumferentially spaced about 20° from the first section of wire.

5. The combination of claim 1, wherein the section of wire wraps helically around said roller about $\frac{1}{8}$ of a turn.

6. The combination of claim 1, wherein said roller comprises a cold pressure fusing roller and wherein said particles comprise electrostatic toner particles.

7. The combination of claim 6, wherein the section of wire wraps helically around said cold pressure fusing roller between about $\frac{1}{4}$ and 1/360 of a turn.

8. The combination of claim 6, further including a second section of wire helically strung across the surface of the cold pressure fusing roller for removing electrostatic toner particles missed by the first section of wire.

9. The combination of claim 8, wherein the second section of wire is circumferentially spaced about 20 degrees from the first section of wire.

10. The combination of claim 6, wherein the section of wire wraps helically around said cold pressure fusing roller about $\frac{1}{4}$ of a turn.

* * * * *